United States Patent [19]

Christianson

[11] 4,152,001

[45] May 1, 1979

[54] SKATEBOARD TRUCK

[76] Inventor: Tony Christianson, 120-8th St., Manhattan Beach, Calif. 90266

[21] Appl. No.: 855,405

[22] Filed: Nov. 28, 1977

[51] Int. Cl.[2] ..... A63C 17/02

[52] U.S. Cl. ..... 280/11.28; 280/87.04 A

[58] Field of Search ..... 280/11.28, 11.27, 11.26, 280/11.19, 11.1 BT, 11.23, 87.03, 87.04 A, 87.04 R

[56] References Cited

U.S. PATENT DOCUMENTS

| | | | |
|---|---|---|---|
| 304,949 | 9/1884 | Mitchell | 280/11.19 |
| 319,839 | 6/1885 | Nelson | 280/11.28 |
| 326,540 | 9/1885 | Baker | 280/11.28 X |
| 921,102 | 5/1909 | Grout | 280/11.28 |
| 1,018,512 | 2/1912 | Mees | 280/11.28 |
| 1,213,454 | 1/1917 | Brown | 280/87.04 A |
| 1,603,529 | 10/1926 | Faust | 280/11.19 |
| 1,935,187 | 11/1933 | Kitselman | 280/11.28 |
| 2,027,254 | 1/1936 | Vogt | 280/87.04 A X |
| 2,126,359 | 8/1938 | Vogt | 280/11.28 |
| 2,413,530 | 12/1946 | Taylor | 280/87.04 A |
| 3,331,612 | 7/1967 | Tietge | 280/11.28 |

FOREIGN PATENT DOCUMENTS

| | | | |
|---|---|---|---|
| 740 of | 1877 | United Kingdom | 280/11.27 |

*Primary Examiner*—Joseph F. Peters, Jr.
*Assistant Examiner*—Milton L. Smith
*Attorney, Agent, or Firm*—Spensley, Horn, Jubas & Lubitz

[57] ABSTRACT

A truck for a skateboard or the like in which one end of a generally S-shaped leaf spring attaches to the skateboard and, through a pivot pin, carries a transverse axle-supporting member at the opposite end. A pair of upwardly and inwardly inclined compression springs, engaged by a pin carried by the leaf spring, resist pivotal movement of the leaf spring relative to the axle-supporting member. The compression of the coil springs can be varied to change the resistance to pivoting. Also, the bushings of the pivot pin for the axle-carrying member can be tightened or loosened to change the pivoting characteristics.

24 Claims, 5 Drawing Figures

SKATEBOARD TRUCK

BACKGROUND OF THE INVENTION

1. Field of the Invention

This invention relates to a truck for a skateboard, roller skate or the like.

2. Description of the Prior Art

Skateboards of prior designs have been deficient in lacking desirable adjustment for changing the wheel steering characteristics of the skateboard. A conventional skateboard truck includes a rubber pad which provides a resilient resistance to wheel steering movement during maneuvering of the board by weight shifting of the rider. The rubber pad returns the wheels to the straight ahead position when the rider's weight is evenly distributed. Although some adjustment may be possible in the compression of the rubber pad, this adjustment is limited in amount and does not permit a variety of wheel turning and centering characteristics to suit the type of riding and maneuvering anticipated, the weight of the rider, and the preferences of the rider.

Springs have been used in roller skate wheel mounting arrangements and, as in U.S. Pat. No. 1,603,529, have been capable of adjustment in resistance by varying the compression of the spring. However, in the design of that patent the spring is twisted during the manipulation of the roller skate rather than given straight compression and the amount of variation is limited as in the conventional skateboard suspension.

SUMMARY OF THE INVENTION

The present invention provides a skateboard truck to enable the skateboard to be set for many different conditions of riding. It can be adjusted for acrobatic maneuvers, downhill runs, or variations of the two, as well as permitting adaptation to suit the weight of the rider and his personal preferences.

The truck includes a generally S-shaped, relatively stiff leaf spring which supports an axle-carrying member between its inclined bottom and intermediate legs. A bolt is used as a pivot pin for the axle-carrying member, with sleeve bearings allowing the pivoting characteristics to be varied by tightening or loosening the bolt.

The axle-carrying member is provided with upwardly and inwardly inclined openings which receive sleeves above which are compression coil springs. Pins fit within these coil springs and are engageable with a transverse pin carried by the leaf spring and positioned between the pins of the axle-carrying member. Consequently, when the skateboard is tilted to one side, the pin of the leaf spring presses downwardly on one of the coil springs, which then affords a resistance to the pivoting movement. These springs are guided by the openings in the axle-carrying member so that they experience linear compression and are not twisted or distorted. The compression in the coil springs is variable by threaded connections on the axle shaft which can move the lower ends of the sleeves inwardly or outwardly. This provides a further adjustment in the wheel turning and centering characteristics.

For straight downhill runs, pivoting of the wheels is made relatively difficult to result in maximum stability to the skateboard. The more firm adjustment of this type dampens oscillations during such riding. Loosening the coil springs and also loosening the pivot pin allows greater pivoting of the wheels which is desirable in acrobatic maneuvering. In all types of riding the leaf spring suspension absorbs bumps and assists in permitting the rider to obtain a better feel of the maneuvers being made, as well as obtaining a more smooth ride.

DESCRIPTION OF THE PREFERRED EMBODIMENT

Figure 1:
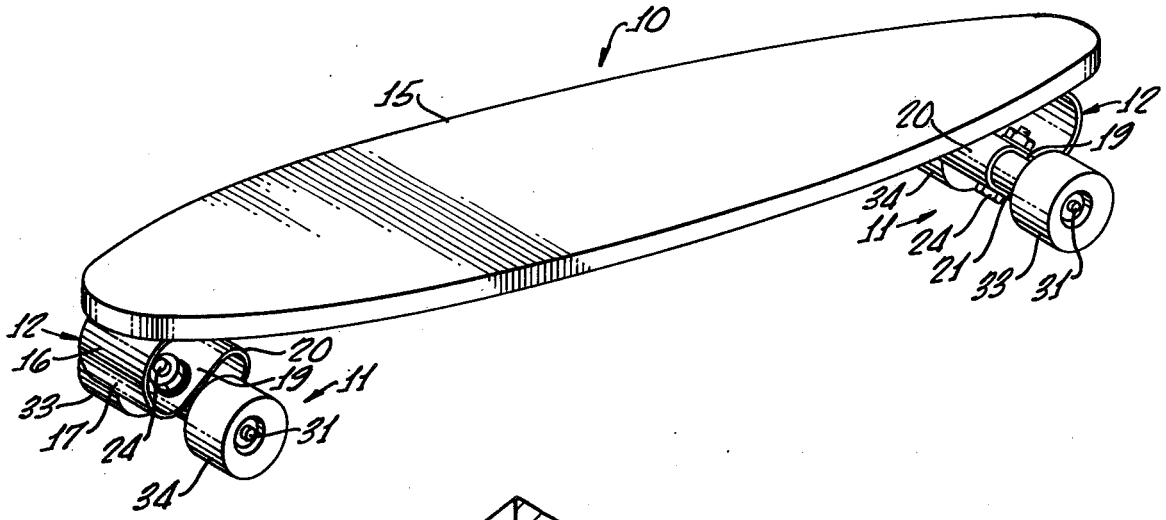
FIG. 1 is a perspective view of a skateboard, utilizing the trucks of this invention.

The skateboard 10, illustrated in FIG. 1, includes identical truck assemblies 11 at its forward and rearward ends, facing in opposite directions.

Figure 2:
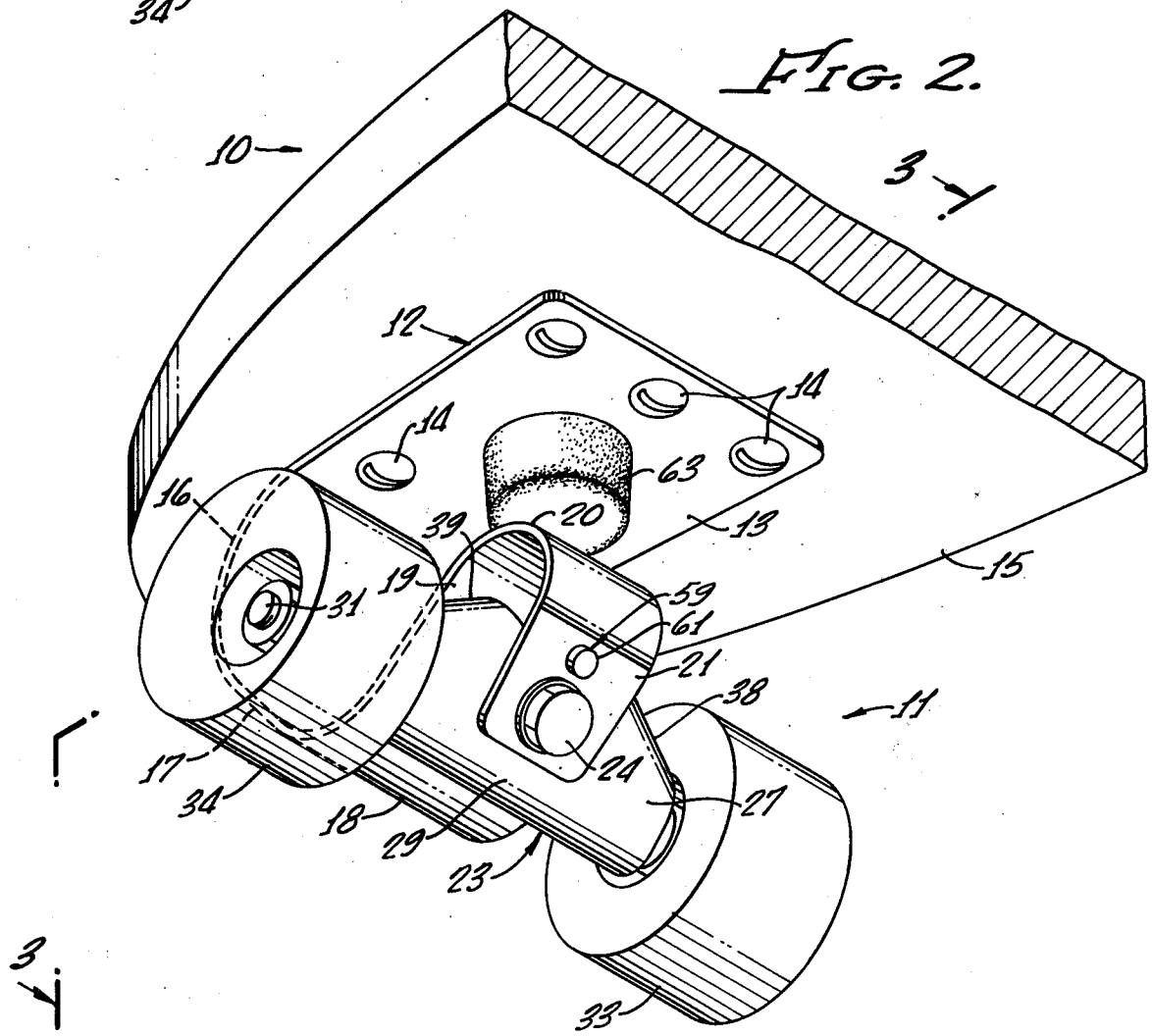
FIG. 2 is an enlarged, fragmentary perspective view of the underside of the skateboard, illustrating one of the trucks and its attachment.
Figure 3:
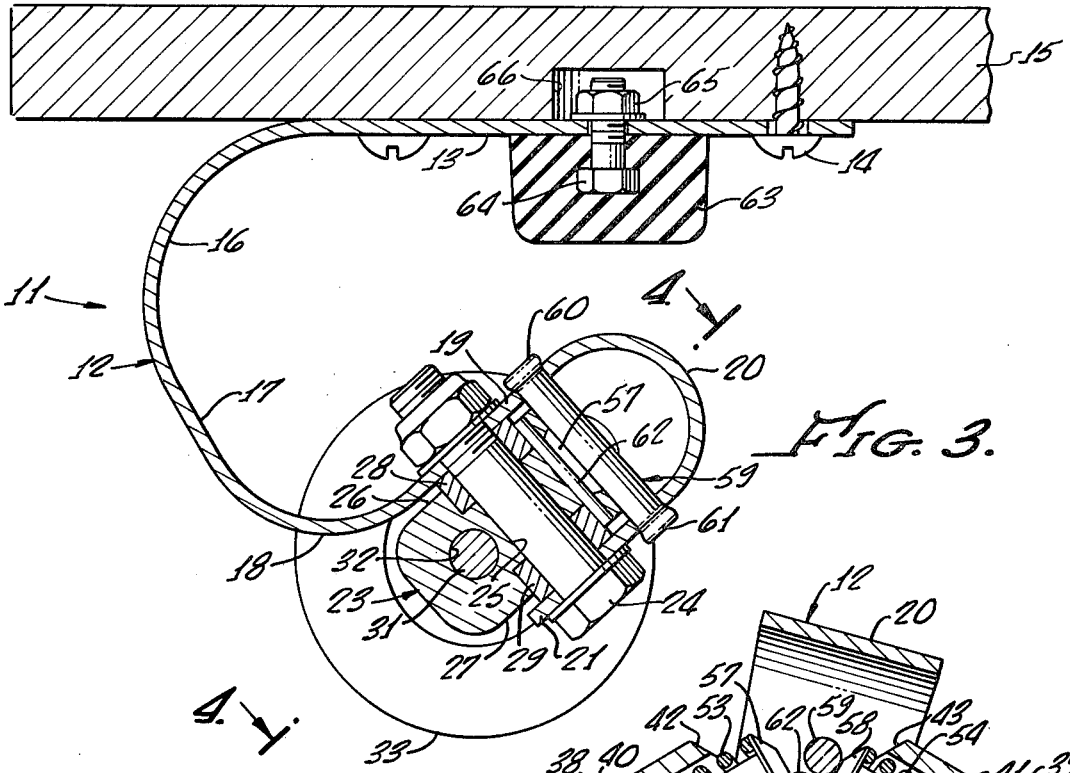
FIG. 3 is a sectional view taken along line 3—3 of FIG. 2.

Each of the skateboard trucks 11 includes a generally S-shaped leaf spring 12 having a flat elongated upper end leg 13 secured by fasteners, such as screws 14, to the undersurface of the platform 15 of the skateboard 10 (FIGS. 2 and 3). Beyond the end leg 13, the spring 12 includes an upper arcuate section 16 that extends to a relatively short straight portion 17 that inclines downwardly as well as inwardly with respect to the ends of the skateboard platform 15. At the lower end of the straight portion 17 is a curved section 18 leading to an intermediate straight section 19, a curved U-shaped portion 20, and a lower end straight section 21. The straight parts 19 and 21 are parallel and incline upwardly and inwardly at an angle of 45° with respect to the platform 15, hence being inclined upwardly at an acute angle relative to the upper spring leg 13 and toward its outer end. The spring 12 is relatively wide at its upper end leg 13, for attachment to the platform 15, and tapers in width toward its lower end leg 21, to provide wheel clearance.

A transverse axle support block 23 fits between and is parallel to the straight intermediate and lower end portions 19 and 21 of the leaf spring 12. The support block 23 is connected to the spring 12 by a bolt 24 which extends through the legs 19 and 21 of the spring, as well as an opening 25 formed in the central portion of the block 23 perpendicular to the sidewalls 26 and 27 of the block 23. The ends of the opening 25 are counterbored to receive sleeve bushings 28 and 29, which may be of plastic material such as that marketed under the trademark "Delrin." The ends of the bushings 28 and 29 project beyond the sidewalls 26 and 27 of the support member 23 and engage the inner faces of the leaf spring sections 19 and 21. This connection enables the support member 23 to pivot relative to the spring 12, and hence relative to the platform 15 of the skateboard, about the longitudinal axis of the bolt 24.

Extending the length of the support block 23 and transverse to the platform 15 is an axle shaft 31 that fits in an opening 32 in the member 23, and is provided with threaded outer ends to connect to wheels 33 and 34. These may be conventional skateboard wheels.

The support block 23 has flat vertical end surfaces 36 and 37 adjacent the wheels 33 and 34, with rounded upper surfaces 38 and 39 inclining inwardly and upwardly from the end surfaces 36 and 37. Elongated cylindrical openings 40 and 41, inclined similarly to the surfaces 38 and 39, extend through the upper portions of the support 23. These openings extend at their upper ends to a central notch in the member 23, above the shank of the bolt 24, defined by flat upper walls 42 and 43, which diverge upwardly from the midportion of the support block 23.

At their lower ends, the openings 40 and 41 extend to the vertical end walls 36 and 37 of the support 23 and intersect the opening 32 for the axle 31. Sleeves 45 and 46 fit within the openings 40 and 41 with their lower corners cut away to provide clearance for the axle 31. The bottom ends 47 and 48 of the sleeves 45 and 46 are cut at an angle relative to their axes so as to be perpendicular to the axle 31. These sleeve ends 47 and 48 bear against washers 49 and 50 which are adjacent the nuts 51 and 52 at the inner faces of the wheels 33 and 34.

Also received in the openings 40 and 41 and bearing against the upper ends of the sleeves 45 and 46 are compression springs 53 and 54. Cylindrical pins 55 and 56 fit within the springs 53 and 54 with their lower ends received in the sleeves 45 and 46. The pins 55 and 56 have integral frustoconical heads 57 and 58 with their flat undersurfaces bearing against the upper ends of the compression springs 53 and 54.

Between the heads 57 and 58 of the pins 55 and 56 is a pin 59 which is transverse to the pins 55 and 56. The pin 59 is parallel to the bolt 24 and above it, extending through the legs 19 and 21 of the spring 12 and provided with upset ends 60 and 61 which secure it to the spring.

Also extending between the heads 57 and 58 of the pins 55 and 56 is a smaller pin 62 which is parallel to the pin 59 and just below it. The pin 62 extends through the wall of the support member 23 along its vertical centerline, between the inclined upper surfaces 42 and 43 at the upper intersection of the openings 40 and 41. There is no connection between the pin 62 and the leaf spring 12.

Figure 5:
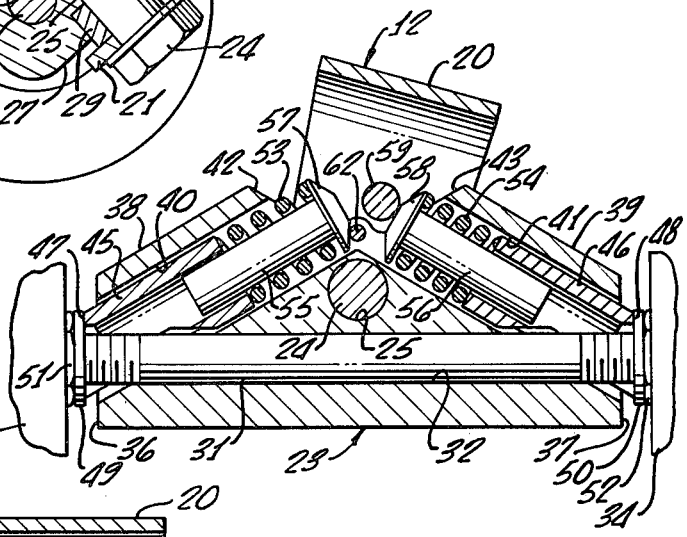
FIG. 5 is a view similar to FIG. 4, but illustrating the leaf spring tilted relative to the axle-supporting member as during maneuvering of the skateboard.
Figure 4:
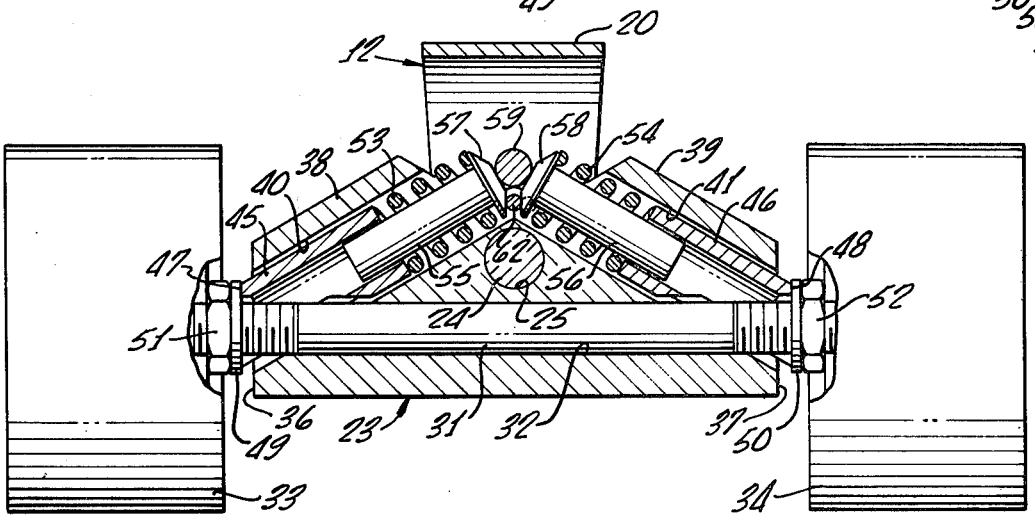
FIG. 4 is a sectional view taken along line 4—4 of FIG. 3.

In the normal position of the skateboard, that is with the platform 15 in a horizontal attitude, the compression springs 53 and 54 press the pins 55 and 56 upwardly so that their heads 57 and 58 bear against both the pins 59 and 62. When the board is to be turned, it is banked by pressing downwardly on one side of the platform 15. This causes the pin 59 to push downwardly on either the pin 55 or the pin 56 of the truck, depending upon which side of the platform is pressed downwardly. As shown in FIG. 5, the pin 59 is pushing downwardly on the pin 56. When this occurs, because of the inclination of the legs 19 and 21 of the spring 12, the support member 23 is caused to pivot about the axis of the bolt 24, which in turn rotates the axle 31 to cause the wheels 33 and 34 to turn for steering the skateboard. This allows maneuvering of the skateboard.

As the pin 59 presses downwardly on one of the pins 55 and 56, the other is held in position by the pin 62 which engages its head and prevents the coil spring from pushing it out of the opening that receives it. In FIG. 5, the head 57 of the pin 55, by engaging the pin 62, is retained within the opening 40 and the sleeve 45.

The springs 53 and 54 are pushed substantially along their axes and are guided by the openings 40 and 41 during turning of the skateboard. This means that the springs experience straight compression and are not twisted or distorted to one side.

When the weight returns to the center of the platform 15, the coil springs return the support 23 to its neutral position and the wheels resume a straight ahead alignment.

The leaf spring 12 is relatively stiff, but provides a desirable resilience to the suspension to assist in the maneuvering of the board and improve its ride. The flat forward lower portion 17 of the leaf spring provides clearance during certain maneuvers which would tend to drive the spring 12 into engagement with the supporting surface beneath the wheels.

Various adjustments can be made to alter the characteristics of the skateboard suspension so that it will suit the type of riding encountered, the weight of the rider, and his personal preferences.

Adjustment of the tension of the bolt 24 will adjust the pivoting characteristics of the axle-carrying member 23. If the bolt 24 is tightened, the intermediate and lower sections 19 and 21 of the leaf spring are pressed against the bushings 28 and 29 and cause the bushings to bear more firmly against the support member 23. This provides an increased frictional resistance to the rotation of the member 23 about the axis of the bolt 24. This may be desirable in downhill operation at high speeds, when the skateboard should be stable beneath the rider. Oscillations of the truck are dampened when the bolt 24 is relatively tight. On the other hand, if the bolt 24 is loosened, the support 23 pivots more readily relative to the spring 12. This setting is preferred during acrobatic-type of maneuvering of the board.

Additional adjustment of the pivoting characteristics of the board can be obtained by adjusting the compression of the springs 53 and 54. This is accomplished through the nuts 51 and 52 on the axle 31. Rotating the nuts 51 and 52 to move them inwardly causes the washers 49 and 50 to push inwardly on the ends 47 and 48 of the sleeves 45 and 46. This moves the sleeves 45 and 46 inwardly and upwardly in the openings 40 and 41. As a result, there is greater tension in the springs 53 and 54, and with it higher resistance to the pivoting of the platform 15 relative to the support 23. Conversely, loosening of the nuts 51 and 52 decreases the spring force and allows the platform 15 of the board to pivot more readily.

The nuts 51 and 52 provide the inner retention for the wheels 33 and 34 as well as for the sleeves 45 and 46, so the wheels are repositioned slightly when the coil springs 53 and 54 are adjusted.

Thus the device of this invention provides a skateboard with a reliable and durable suspension system which at the same time is adjustable to suit the rider and the type of maneuvering which is anticipated.

In order to prevent the spring 13 from deflecting too much during maneuvers which impose high "g" loads on the suspension, as well as for accommodating heavy skateboard riders, the rubber pad 63, seen in FIGS. 2 and 3, may be attached to the underside of the upper spring leg 13. The pad 63 acts as a snubber that can be engaged by the U-shaped portion 20 of the spring 12 upon deflection of the spring, to prevent collapse of the spring to the point where the portion 20 engages the upper leg 13. The pad 63 is molded around a bolt 64, the shank of which extends through an opening in the upper spring leg 13 and is received in a nut 65 for attaching the pad to the spring. A recess 66 in the underside of the skateboard platform 15 provides clearance for the nut 65 and upper end of the bolt shank.

In lieu of the pad 63, a compression spring may be positioned between the U-shaped spring portion 20 and the upper spring leg 13.

Although described as used in conjunction with a skateboard, the truck of this invention is usable with roller skates, as well.

The foregoing detailed description is to be clearly understood as given by way of illustration and example only, the spirit and scope of this invention being limited solely by the appended claims.

I claim:

1. A truck for a skateboard or the like comprising:
a duality of wheels;
an axle, said wheels being carried by opposite ends of said axle,
an axle-carrying means carrying said axle, and
means for connecting said axle-carrying means to a member to be supported, said connecting means including:
a leaf spring having an upper leg adapted for connection to said member to be supported, an intermediate leg, a lower leg, a first portion interconnecting said upper leg and said intermediate leg, and a second portion interconnecting said intermediate leg and said lower leg, said axle-carrying means being received between said intermediate and lower legs, and
means pivotally connecting said axle-carrying means to said intermediate and lower legs.

2. A device as recited in claim 1 in which said intermediate and said lower legs are substantially parallel and at an angle relative to said upper leg.

3. A device as recited in claim 2 in which said means for connecting said axle-carrying means to said member to be supported includes resilient means for resisting pivotal movement of said axle-carrying means relative to said leaf spring.

4. A device as recited in claim 3 including means for adjusting the force of said resilient means for thereby adjusting the resistance said resilient means provides to said pivotal movement of said axle-carrying means relative to said leaf spring.

5. A device as recited in claim 1 in which said means pivotally connecting said axle-carrying means to said intermediate and lower legs includes:
an elongated shank extending through said axle-carrying means and through said intermediate and lower legs for providing a pivot axis,
bushing means around said shank and in abutment with at least one of said intermediate and lower legs, and
threaded means for compressing said bushing means between said at least one leg and said axle-carrying means for resisting said pivotal movement and dampening vibrations.

6. A device as recited in claim 5 in which said bushing means includes a duality of said bushings, positioned one on either side of said axle-carrying means and in abutment with said intermediate and lower legs respectively, and in which a bolt defines said shank and said threaded means, with the head of said bolt being adjacent one of said bushings and the nut of said bolt being adjacent the other of said bushings.

7. A device as recited in claim 5 in which said bushing means includes
a duality of said bushings, positioned one on either side of said axle-carrying means and between said intermediate and lower legs of said leaf spring, and
said threaded means includes a first element adjacent said intermediate leg of said leaf spring and on the side thereof remote from said axle-carrying means,
and a second element adjacent said lower leg of said leaf spring and on the side thereof remote from said axle-carrying means,
said first and second elements compressing said intermediate and lower legs against said bushings for so compressing said bushings against said axle-carrying means.

8. A device as recited in claim 1 in which said axle-carrying means includes
a member defining a duality of openings inclined inwardly and upwardly from outer ends of said member so that said openings converge,
a sleeve received in the lower end portion of each of said openings, means retaining the lower ends of said sleeves,
a coil compression spring in the upper end portion of each of said openings,
the lower end of each of said coil springs engaging one of said sleeves,
a member engaging the upper end of each of said coil springs,
and means connected to said leaf spring for engaging said members at said upper ends of said coil springs,
whereby when said leaf spring is pivoted in one direction relative to said axle-carrying means said means connected to said leaf spring pushes on one of said coil springs so that said one coil spring resists said pivotal movement, and when said leaf spring is pivoted in the opposite direction relative to said axle-carrying means said means connected to said leaf spring pushes on the other of said coil springs so that said other coil spring resists said pivotal movement in the opposite direction.

9. A device as recited in claim 8 including in addition a retention member carried by said axle-carrying means and positioned adjacent the upper ends of said coil springs, whereby when said means connected to said leaf spring pushes on one of said coil springs said retention member carried by said axle-carrying means retains the other of said coil springs in said axle-carrying means.

10. A device as recited in claim 8 in which said means retaining the lower ends of said sleeves is adjustable in position to thereby adjust the forces of said coil springs.

11. A device as recited in claim 8 in which
said axle has threaded ends,
and nuts on said threaded ends, said lower ends of said sleeves being adjacent said nuts so that said means retaining the lower ends of said sleeves includes said nuts, and upon rotation of said nuts relative to said axle said nuts adjust the positions of said sleeves, for thereby adjusting the forces exerted by said coil springs.

12. A device as recited in claim 11 in which said nuts are adjacent the inner faces of said wheels and provide retention of said wheels against movement inwardly relative to said axis.

13. A device as recited in claim 1 in which said intermediate and lower legs are inclined at an acute angle relative to said upper leg, and including in addition resilient means between said upper leg and said second portion interconnecting said intermediate and lower legs for resisting at least some deflection of said leaf spring.

14. A device as recited in claim 13 in which said resilient means includes a pad of elastomeric material adjacent the undersurface of said upper leg.

15. A truck for a skateboard or the like comprising:
a duality of wheels,
an axle, said wheels being carried by opposite ends of said axle,
an axle-carrying means carrying said axle, and
means for connecting said axle-carrying means to a member to be supported, said connecting means including:
a first member adapted for connection to a member to be supported,
means for pivotally connecting said axle-carrying means to said first member,
a duality of resilient members for resisting pivotal movement of said axle-carrying means relative to said first member, said resilient members being inclined inwardly from outer ends thereof relatively adjacent said wheels so as to converge at inner ends thereof relatively remote from said wheels, and
an element carried by said first member extending to a position intermediate said inner ends of said resilient members for compressing one of said resilient members upon pivotal movement of said axle-carrying means relative to said first member in one direction and for compressing the other of said resilient members upon pivotal movement of said axle-carrying means relative to said first member in the opposite direction.

16. A device as recited in claim 15 in which said resilient members are springs, and said axle-carrying means includes means for guiding said springs so that said springs experience substantially direct compression along the axes thereof upon said pivotal movement of said axle-carrying means relative to said first member.

17. A device as recited in claim 16 including means for adjustably compressing said springs for varying the resistance thereof to said pivotal movement of said axle-carrying means relative to said first member.

18. A device as recited in claim 15 in which said means for pivotally connecting said axle-carrying means to said first member includes an elongated member carried by said first member and extending through the central portion of said axle-carrying means adjacent said inner ends of said resilient members, said axle-carrying means being pivotal around the axis of said elongated member.

19. A device as recited in claim 18 including means for causing an adjustable resistance to said pivoting of said axle-carrying means around said axis of said elongated member.

20. A truck for a skateboard having a truck supporting member, said truck comprising:
an axle support block pivotally attachable to said supporting member, said block having a central notch adjacent the location of pivotal attachment,
an axle contained within an axle bore extending through said support block, the ends of said axle being attachable to a pair of wheels,
first and second oblique bores within said support block extending respectively from said central notch towards the opposite ends of said axle bore, and
first and second adjustable resilient members disposed within said first and second oblique bores, said resilient members being respectively independently compressible by a compression means on said support member upon pivoting of said support block about said pivotal attachment location.

21. A skateboard truck according to claim 20 wherein said oblique bores intersect and open into the end portions of said axle bore, said truck further comprising:
adjustment members disposed within said oblique bores between said resilient members and said axle, and
axle retaining nuts adjustably engaging theads on said axle, said adjustment members abuting against said nuts, adjustment of said nuts moving the position of said adjustment members within said bores so as to alter the effective compression resisting force provided by said resilient means.

22. A skateboard truck according to claim 20:
wherein the axes of said axle bore and said first and second oblique bores form a triangle, said pivotal attachment location being within said triangle, said central notch being at the apex of said triangle opposite said axle bore,
wherein said first and second oblique bores respectively open to said notch on opposite sides of said apex, said pivotal attachment location being situated so that when said truck is attached to said support member said compression means will be situated near said apex, said resilient members each projecting into said notch,
pivoting of said truck in a first direction causing said compression means to contact and compress the resilient member disposed in one of said oblique bores, pivoting of said truck in the opposite direction causing said compression means to contact and compress the resilient member disposed in the other of said oblique bores.

23. A skateboard truck according to claim 22 wherein a portion of said oblique bores adjacent said central notch overlap, said truck further comprising:
a pin mounted to said support block and extending across said overlaping portion of said oblique bores, said pin contacting and preventing outward motion of one resilient member when the other resilient member is compressed by said compression means.

24. A skateboard truck according to claim 20 together with a truck supporting member comprising:
a flat metal spring having a generally S-shape including:
a flat upper leg configured for attachment to the underside of a skateboard,
an arcuate section extending from said upper leg, and
a generally U-shaped section including a first leg extending from said arcuate section beneath and at an acute angle with respect to said upper leg, a second leg beneath and generally parallel to said first leg, and a curved section joining said first and second legs,
said truck being situated between and pivotally attached to said first and second legs with said central notch facing said curved section, said compression member comprising a pin extending between said first and second legs within said central notch.

* * * * *